US007027000B2

(12) United States Patent
Takagi et al.

(10) Patent No.: US 7,027,000 B2
(45) Date of Patent: Apr. 11, 2006

(54) ANTENNA

(75) Inventors: Naoyuki Takagi, Kyoto (JP); Akihiko Iguchi, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 11/006,706

(22) Filed: Dec. 8, 2004

(65) Prior Publication Data

US 2005/0128162 A1 Jun. 16, 2005

(30) Foreign Application Priority Data

Dec. 10, 2003 (JP) ..... 2003-411453
Aug. 25, 2004 (JP) ..... 2004-245579

(51) Int. Cl.
*H01Q 1/24* (2006.01)

(52) U.S. Cl. ..... 343/702; 343/767; 343/795

(58) Field of Classification Search ..... 343/702, 343/700 MS, 795, 797, 815, 846, 848, 767
See application file for complete search history.

(56) References Cited

U.S. PATENT DOCUMENTS 5,990,838 A * 11/1999 Burns et al. ..... 343/702
6,456,249 B1 * 9/2002 Johnson et al. ..... 343/702
2003/0210199 A1 * 11/2003 Sward et al. ..... 343/795

FOREIGN PATENT DOCUMENTS

JP 63-60628 3/1998

* cited by examiner

*Primary Examiner*—Tuyet Vo
*Assistant Examiner*—Jimmy Vu
(74) *Attorney, Agent, or Firm*—McDermott Will & Emery LLP

(57) ABSTRACT

The present invention can be used for mobile communication and is able to provide an antenna which can assure excellent radiation characteristic, decreasing the degree of coupling between two antenna elements without using any changeover switch. The second antenna element of this antenna is nearly half in length of the wavelength of corresponding frequency, and its tip is connected to the grounding point of a ground plane.

8 Claims, 4 Drawing Sheets

ANTENNA

FIELD OF THE INVENTION

The present invention relates to an antenna mainly used for mobile communication such as portable telephone and wireless equipment.

BACKGROUND OF THE INVENTION

Recently, mobile communication including portable telephone is developing from communication by voice into communication by data such as characters and moving pictures. Accordingly, an antenna for receiving radio waves is also required to be higher in performance.

A conventional antenna will be described with reference to FIG. 7 and FIG. 8.

FIG. 7 and FIG. 8 are schematic diagrams of conventional antennas, and the one shown in FIG. 7 is first described.

In the conventional one shown in FIG. 7, first wireless circuit 107 is connected to one end of first transmission line 105 disposed above ground plane 109. First feeder portion 103 is connected to the other end of first transmission line 105. And, first antenna element 101 is connected to first feeder portion 103. First antenna element 101 is extended to the top side of ground plane 109.

Further, similarly, second wireless circuit 108 is connected to one end of second transmission line 106 disposed above ground plane 109. Also, second feeder portion 104 is connected to the other end of second transmission line 106. And, second antenna element 102 is connected to second feeder portion 104. Second antenna element 102 is also extended to the top side of ground plane 109.

In the above configuration, first antenna element 101 resonates with the radio waves of the first frequency. In the receiving mode, current excited by radio wave received by first antenna element 101 is transferred from first feeder portion 103 to first wireless circuit 107 via first transmission line 105, and thereby, the radio wave are received.

On the other hand, in the transmitting mode, signal generated in first wireless circuit 107 is transferred from first transmission line 105 via first feeder portion 103 and is excited by first antenna element 101 to be emitted as radio waves and transmitted.

And, second antenna element 102 resonates with the radio waves of the second frequency, which is able to transmitted and receive radio wave on the same principle as for first antenna element 101.

Thus, as the setting is such that first antenna element 101 and second antenna element 102 respectively resonate with radio waves of different frequencies, the antenna shown in FIG. 7 is able to cope with two different communication systems.

And, in the conventional antenna shown in FIG. 8 that is different in configuration from FIG. 7, changeover switch 110 and changeover switch 111 are additionally inserted into first transmission line 105 and second transmission line 106 respectively.

The other components are same as those of FIG. 7, and the description is omitted.

In FIG. 8, when transmitting and receiving the radio waves of the first frequency, the antenna operates with changeover switch 10 turned ON and changeover switch 11 turned OFF. Also, when transmitting and receiving the radio waves of the second frequency, it operates with changeover switch 10 turned OFF and changeover switch 11 turned ON.

As prior art document information related to the present invention, for example, Japanese Patent Laid-Open Application No. S63-60628 can be mentioned.

SUMMARY OF THE INVENTION

An antenna, comprising:

a first transmission line disposed above a ground plane;

a first wireless circuit connected to one end of the first transmission line;

a first feeder portion connected to the other end of the first transmission line;

a first antenna element connected to the first feeder portion;

a second transmission line disposed above the ground plane;

a second wireless circuit connected to one end of the second transmission line;

a second feeder portion connected to the other end of the second transmission line; and a second antenna element connected to the second feeder portion, wherein at least the second antenna element is nearly half in length of the wavelength of corresponding frequency, and its tip is grounded to the ground plane.

DETAILED DESCRIPTION OF THE EXEMPLARY EMBODIMENTS

Figure 7:
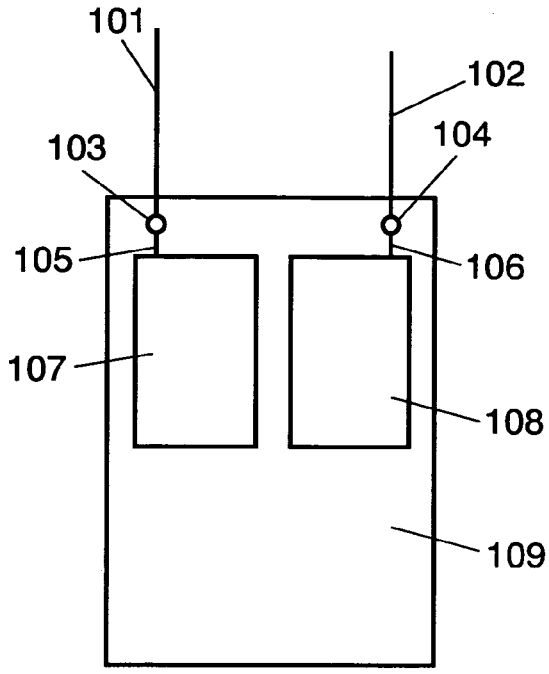
FIG. 7 PRIOR ART
FIG. 7 is a schematic diagram of a conventional antenna.

In the conventional antenna shown in FIG. 7, for making the setting such that first antenna element 101 is resonant with DCS (Digital Cellular System, 1710 to 1880 MHz), and second antenna element 102 is resonant with UMTS (Universal Mobile Telecommunication System, 1920 to 2170 MHz), there are problems as described in the following.

That is, since two frequency bands are close to each other, when second antenna element 102 is operated, high-frequency current generated due to resonance between second antenna element 102 and ground plane causes first antenna element 101 to be excited via ground plane 109. Thus, first antenna element 101 is also excited.

In this case, since same ground plane 109 is used for the excitation, the coupling between first antenna element 101 and second antenna element 102 is strengthened. As a result, there also arises a problem that the radiation characteristic is deteriorated.

Also, when first antenna element 101 is operated, similarly, the coupling between it and second antenna element 102 is strengthened. As a result, there arises a problem that the radiation characteristic is deteriorated.

Figure 8:
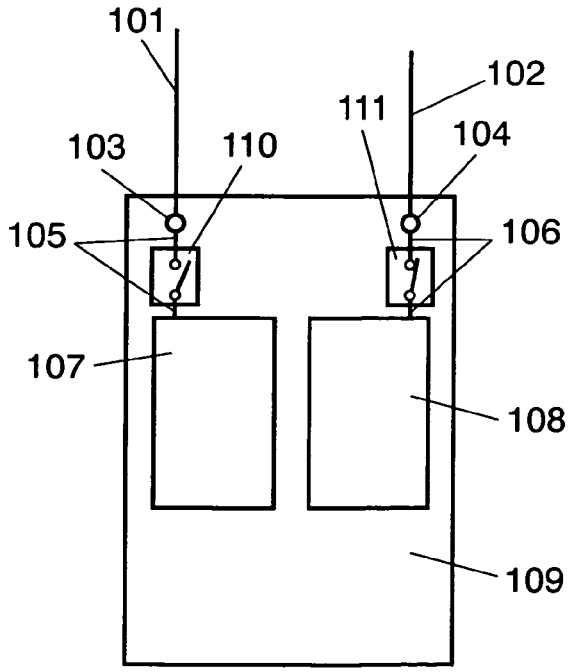
FIG. 8 PRIOR ART
FIG. 8 is a schematic diagram of a conventional antenna with changeover switches inserted therein.

In such a case, as shown in FIG. 8, if configured in that changeover switch 110 and changeover switch 111 are additionally inserted for changeover in use, the problem will be relieved. However, there arises such problem that it is necessary to dispose changeover switches 110, 111 and control units or the like.

The present invention is intended to solve such conventional problems, and the object is to provide an antenna which can decrease the coupling between the two antenna elements without using changeover switch and assure excellent radiation characteristic.

The exemplary embodiment of the present invention will be described in the following with reference to FIG. 1 to FIG. 6.

For the components same as the components mentioned in the description of prior art, the description is simplified.

(Exemplary Embodiment)

Figure 1:
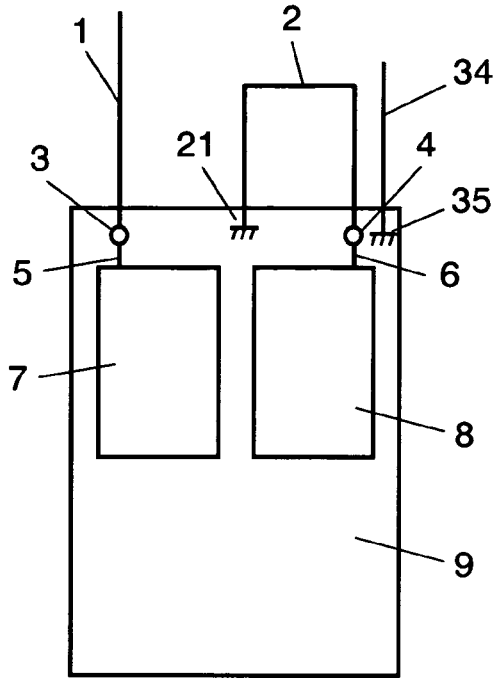
FIG. 1 is a schematic diagram of an antenna in one exemplary embodiment of the present invention.

FIG. 1 is a schematic diagram of an antenna in one exemplary embodiment of the present invention. In FIG. 1, first transmission line 5 is disposed above ground plane 9, and first wireless circuit 7 is connected to one end of the first transmission line 5. Also, first feeder portion 3 is connected to the other end of first transmission line 5. And, first antenna element 1 is connected to the first feeder portion 3. First antenna element 1 is extended to the top side of ground plane 9.

Similarly, second wireless circuit 8 is connected to one end of second transmission line 6 disposed above ground plane 9. Also, second feeder portion 4 is connected to the other end of second transmission line 6. Second antenna element 2 is connected to second feeder portion 4.

And, second antenna element 2 is set nearly half in length of the wavelength of corresponding frequency, and its tip is connected to grounding point 21 of ground plane 9. The middle portion of second antenna element 2 is disposed on the top side of ground plane 9.

In the above configuration, first antenna element 1 resonates with the corresponding frequency of DCS (frequency band used in DCS) to transmit and receive radio wave. And, second antenna element 2 resonates with the corresponding frequency of UMTS (frequency band used in UMTS) to transmit and receive radio waves. That is, the antenna is able to cope with two different communication systems.

In this case, two corresponding frequencies sent and received by first antenna element 1 and second antenna element 2 are close to each other. However, second antenna element 2 is nearly half in length of the wavelength of corresponding frequency, and its tip is connected to grounding point 21. Accordingly, when it is operated, grounded second antenna element 2 operates as one-wavelength loop antenna and can suppress the resonance at ground plane 9, thereby minimizing the influence of coupling between it and first antenna element 1.

On the other hand, when first antenna element 1 is operated, second antenna element 2 itself grounded to ground plane 9 also becomes nearly half in length of the wavelength of DCS frequency. Accordingly, the current excited at feeder portion 4 of second antenna element 2 can be decreased, thereby reducing the influence caused by second antenna element 2.

As described above, in this configuration, the degree of coupling between two antenna elements corresponding to frequencies being close to each other can be decreased, and it is possible to realize excellent radiation characteristic.

Also, since second antenna element 2 functions as one-wavelength loop antenna, second antenna element 2 tends to increase in characteristic impedance. In order to suppress this phenomenon, in the present exemplary embodiment, parasitic antenna element 34 is disposed side by side with second antenna element 2, and grounding point 35 of the parasitic antenna element 34 is disposed in the vicinity of second feeder portion 4 in second antenna element 2.

Since parasitic antenna element 34 is disposed in the vicinity of antenna element 2, capacity component is added between second antenna element 2 and parasitic antenna element 34. Accordingly, the capacity component added between second antenna element 2 and parasitic antenna element 34 can be adjusted by adjusting the length of parasitic antenna element 34 or the interval between parasitic antenna element and second antenna element 2. As a result, the characteristic impedance of second antenna element 2 can be freely adjusted. Further, it is possible to obtain excellent radiation characteristic.

Also, a configuration with a high reactance element connected in series fashion to second antenna element 2 is usually employed for such impedance matching of second antenna element 2. However, the purpose of characteristic impedance matching can be achieved to some extent by disposing parasitic antenna element 34. Accordingly, the reactance component of a high reactance element can be decreased, and consequently, matching losses due to reactance element can be reduced.

Parasitic antenna element 34 functions as an impedance matching element as described above, and in addition to this, it displays the function shown in the following. That is, when the electric length of parasitic antenna element 34 is set to a quarter or less wavelength, parasitic antenna element 34 functions as a director, and when the electric length of parasitic antenna element 34 is set to a quarter or more wavelength, it functions as a reflector. Accordingly, parasitic antenna element 34 can function as a directional control element of second antenna element 2 as well.

That is, setting the electric length of parasitic antenna element 34 to a quarter or less wavelength, the directivity of second antenna element 2 can be directed to the side opposite to first antenna element 1. In this way, the degree of space coupling between first antenna element 1 and second antenna element 2 can be decreased.

When grounding point 21 of second antenna element 2 is disposed between first feeder portion 3 and second feeder portion 4, the feeder portions of two antenna elements are spaced apart from each other, and the degree of coupling between two antenna elements can be decreased.

Figure 2:
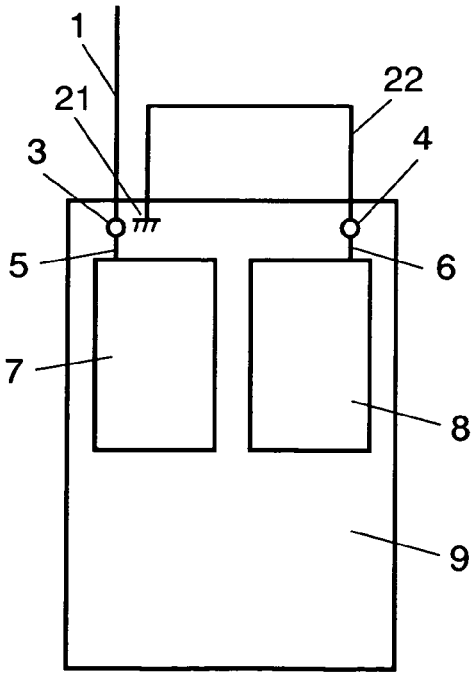
FIG. 2 is a schematic diagram of an antenna with the grounding point of the second antenna element disposed in the vicinity of the first feeder portion.

Also, as shown in FIG. 2, when grounding point 21 of second antenna element 22 is disposed between first feeder portion 3 and second feeder portion 4 and in the vicinity of the first feeder portion 3, increasing the distance between second feeder portion 4 and grounding point 21, then second antenna element 22 is spaciously arranged, thereby improving the characteristic of non-directivity.

In FIG. 2, those with same reference numerals as in FIG. 1 display same operations, and the detailed description is omitted.

Figure 3:
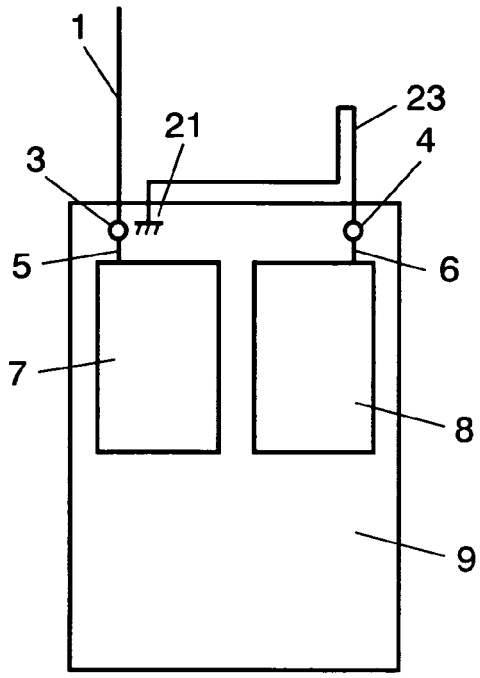
FIG. 3 is a schematic diagram of an antenna bent in the vicinity of the grounded portion of the second antenna element.

Further, as shown in FIG. 3, second antenna element 23 is bent in the vicinity of the grounded portion thereof in the direction of going apart from first antenna element 1, thereby decreasing the degree of proximity between first antenna element 1 and second antenna element 23, and then the coupling between the two antenna elements can be further decreased.

In FIG. 3, those with same reference numerals as in FIG. 1 display same operations, and the detailed description is omitted.

First antenna element 1 and second antenna 2 are not limited to a line configuration.

Figure 4:
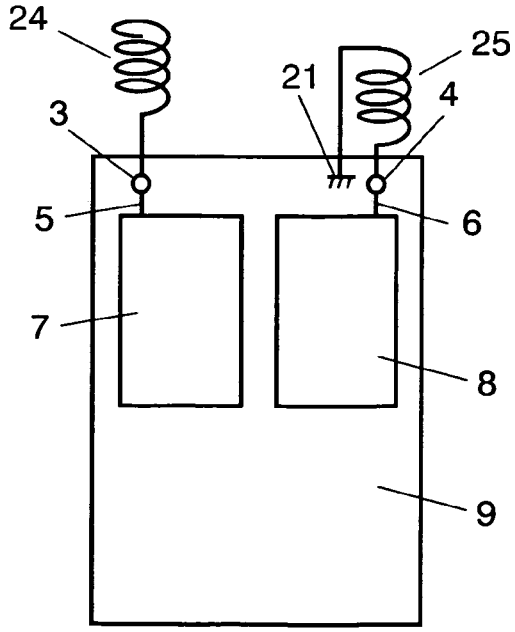
FIG. 4 is a schematic diagram of an antenna with a part of antenna element spirally formed.

As a specific example, as shown in FIG. 4, first antenna element 24 and second antenna element 25 are preferable to be spirally configured in order to reduce the size. Same effects can be obtained even when the whole or a part of the antenna element is configured in meandering or flat shape.

In FIG. 4, those with same reference numerals as in FIG. 1 to FIG. 3 display same operations, and the detailed description is omitted.

Also, in the configuration described above, first antenna element 1 is resonant with one frequency, but same effects can be obtained even when it is resonant with two or more frequencies.

Figure 5:
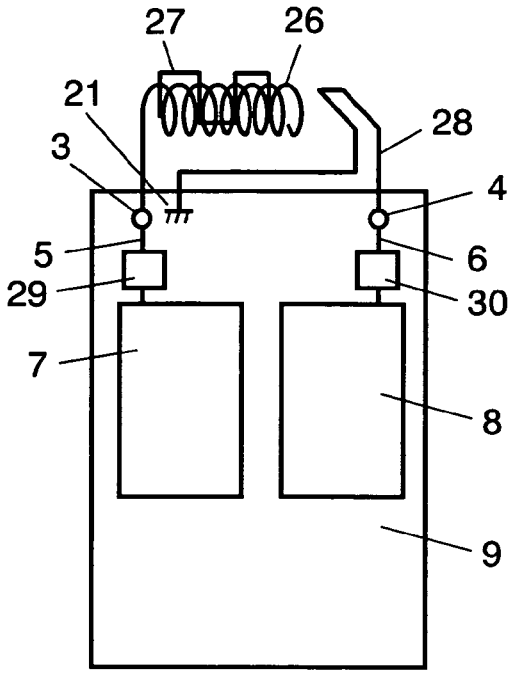
FIG. 5 is a schematic diagram of an antenna wherein the first antenna element resonates with two frequencies.

As a specific example, as shown in FIG. 5, when the first antenna element is configured with spiral portion 26 and meandering portion 27, the first antenna element is able to resonate with two frequencies. Accordingly, with the first antenna element and second antenna element 28 combined, it is possible to set up an antenna that can cope with three frequencies, that is, three communication systems.

Also, as shown in FIG. 5, when first matching circuit 29 and second matching circuit 30 are respectively inserted into first transmission line 5 and second transmission line 6, it is possible to set up an antenna that can cover a broad band at the desired high frequency even with use of a small-sized antenna element.

Also, when configured in that the antenna element is held by insulating resin, it is possible to miniaturize the antenna element due to the permittivity of the insulating resin, and the size can be further reduced.

In FIG. 5, those with same reference numerals as in FIG. 1 to FIG. 4 display same operations, and the detailed description is omitted.

Figure 6:
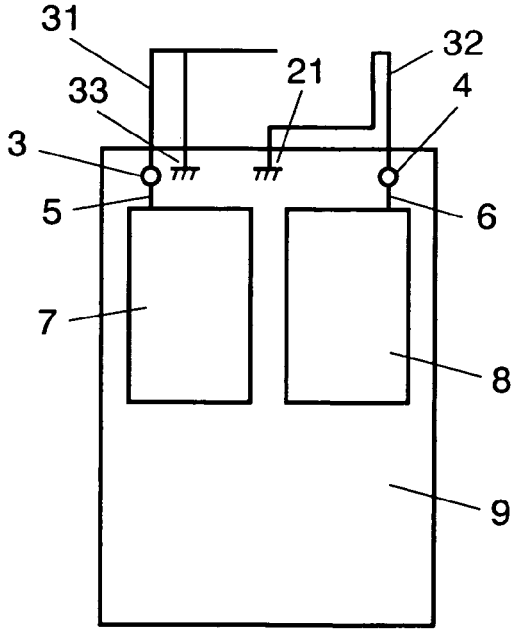
FIG. 6 is a schematic diagram of an antenna wherein the first antenna element is grounded.

As shown in FIG. 6, when first antenna element 31 is configured as a reverse-F antenna connected to grounding point 33, the impedance of first antenna element 31 can be freely adjusted.

In FIG. 6, those with same reference numerals as in FIG. 1 to FIG. 5 display same operations, and the detailed description is omitted.

Further, in any configuration described above, an antenna element is disposed at the top side of ground plane 9, but it is preferable to dispose an antenna on the whole or a part of the surface of ground plane 9, and in this case, the capacity coupling with ground plane 9 can be easily adjusted, thereby increasing the freedom of impedance adjustment.

In those shown in FIG. 2 to FIG. 6, the same as in those shown in FIG. 1, it is preferable to connect one end of parasitic antenna element 34 to a part near the second feeder portion in ground plane 9, and same effect as described above can be obtained.

According the present invention as described above, at least one of two antenna elements is nearly half in length of the wavelength of corresponding frequency, and its tip is grounded to a ground plane. Therefore, even in case the corresponding frequencies of the antenna element are close to each other, when the grounded antenna element side is operated, it operates as a one-wavelength loop antenna. Accordingly, it is possible to suppress the resonance at the ground plane, and the interference with other antenna can be decreased. Also, when the other antenna element side is operated, since the length of the second antenna element itself grounded to the ground plane is nearly half the wavelength of the corresponding frequency, the current excited by the feeder portion of the second antenna element can be reduced. Thus, the influence given by the second antenna can also be reduced.

Consequently, it is possible to obtain such advantage that an antenna having excellent radiation characteristic and decreased in coupling between two antenna elements can be realized without using changeover switch, and this is useful for mobile information such as portable telephone in particular.

What is claimed is:

1. An antenna, comprising:

a first transmission line disposed above a ground plane;

a first wireless circuit connected to one end of the first transmission line;

a first feeder portion connected to the other end of the first transmission line;

a first antenna element connected to the first feeder portion;

a second transmission line disposed above the ground plane;

a second wireless circuit connected to one end of the second transmission line;

a second feeder portion connected to the other end of the second transmission line; and a second antenna element connected to the second feeder portion, wherein at least the second antenna element is nearly half in length of the wavelength of corresponding frequency, and its tip is grounded to the ground plane.

2. The antenna of claim 1, wherein the tip of the second antenna element is arranged between the first feeder portion and the second feeder portion.

3. The antenna of claim 1, wherein the tip of the second antenna element is grounded at a position apart from the feeder portion of the second antenna element in the vicinity of the feeder portion of the first antenna element.

4. The antenna of claim 1, wherein the second antenna element is bent in the vicinity of the grounded portion thereof in a direction of going apart from the first antenna element.

5. The antenna of claim 1, wherein at least one of the first antenna element and the second antenna element is spirally formed.

6. The antenna of claim 1, wherein at least one of the first antenna element and the second antenna element is entirely or partially formed in meandering or flat shape.

7. The antenna of claim 1, wherein the first antenna element is configured as a reverse-F antenna.

8. The antenna of any one of claim 1 to claim 7, further comprising a parasitic antenna element with its one end connected to a portion near the second feeder portion of the ground plane.

* * * * *